US005141046A

United States Patent [19]

Duncan

[11] Patent Number: 5,141,046

[45] **Date of Patent: * Aug. 25, 1992**

[54] SECURITY SCREENS

[75] Inventor: Fred Duncan, Pearland, Tex.

[73] Assignee: NrG Products Manufacturing Corporation, Pearland, Tex.

[ * ] Notice: The portion of the term of this patent subsequent to Jun. 12, 2007 has been disclaimed.

[21] Appl. No.: 518,742

[22] Filed: May 2, 1990

Related U.S. Application Data

[63] Continuation of Ser. No. 57,444, May 11, 1987, Pat. No. 4,932,457.

[51] Int. Cl.[5] ..... A47G 5/00

[52] U.S. Cl. ..... 160/379; 160/371; 49/484

[58] Field of Search ..... 160/380, 371, 379; 411/531, 548, 525; 49/504, 484, 489

[56] References Cited

U.S. PATENT DOCUMENTS

| | | | |
|---|---|---|---|
| 1,273,222 | 7/1918 | Higgin et al. | 160/379 |
| 1,602,096 | 10/1926 | Barnes | 160/379 |
| 1,788,296 | 1/1931 | Herndon | 160/379 |
| 3,002,253 | 10/1961 | Kessler | 49/489 X |
| 4,182,088 | 1/1980 | Ball | 160/395 X |
| 4,932,457 | 6/1990 | Duncan | 160/380 |

*Primary Examiner*—Blair M. Johnson
*Attorney, Agent, or Firm*—David M. Ostfeld

[57] ABSTRACT

Improvements to the design of metal frames of security screens are disclosed. The improvement, each of which may be applied individually or in conjunction with any combination or all of the other improvements, include a retainer groove in the frame into which is inserted the ends of the screen mesh and of a tension retainer bar to prevent the mesh and bar from pulling away from the screen frame when a force is applied against the screen mesh, a second line of tension retainer bar fasteners, grooves on the retainer wall of the tension retainer bar to prevent fasteners from slipping during insertion, vinyl or felt extender tongues extending from the frame perpendicularly to each other, refinements to the design of the screen frame to maintain the structural integrity of the screen frame while accommodating the aforesaid retainer groove, and the insertion of the ends of a center brace into slots in the outside frame members or the use of insertion keys to better secure the center brace.

1 Claim, 2 Drawing Sheets

SECURITY SCREENS

This is a continuation of application Ser. No. 057,444, filed May 11, 1987, now U.S. Pat. No. 4,932,457.

TECHNICAL FIELD

The invention relates to screens that are installed on windows, doors, porches, or otherwise on buildings and that are constructed to enhance the security of the building and/or to resist vandalism. More specifically, the invention relates to improvements to the construction of screen frames which (i) increase resistance to accidents or attempts to push, pull, rip or otherwise separate the screen mesh from the frame, or (ii) facilitate construction of the screen, or (iii) improve the fit of the screen against the building on which the screen is installed.

BACKGROUND ART

In the prior art, various means of securing wire mesh screens for window and doors to frames of aluminum, stainless steel, or similar material, including means by which resistance is maximized against attempts to pull or rip the screen from the frame and by which tension of the screen is maintained, are known. To construct screens with a light screen mesh, the mesh is attached to the screen frame by use of a roller which forces a cylindrically shaped rubber strip over the mesh lengthwise near the edge of the mesh and into a groove in the frame, so that the mesh is wedged tightly in the groove between the frame and the rubber strip.

For heavier weight mesh materials, these means of securing a screen to its frame include the use of a tension retainer bar, whereby the edges of the screen are sandwiched between the longer arm of an L-shaped frame and the tension retainer bar, and regularly-spaced fasteners (e.g. metal screws) are driven through the retainer bar, the screen, and the retainer wall of the frame along the entire length of the edges of the screen. In addition, there may be slightly raised ridges on, and running the full length of, the underside of the retainer bar and the surface of the frame, abutting tightly against the screen mesh. In this manner, the screen is secured by pressure applied to a more or less even extent along the entire length of its edges and over a width more or less equal to the width of the retainer bar, rather than concentrating the holding pressure of the screen to the points at which the fasteners are inserted through the screen which would expose the screen locally to sheer tears.

It is also known in the prior art to equip a screen frame (whether rectangular or L-shaped) with vinyl or felt extender tongues which extend out from the frame on the same plane as the screen mesh, in order to compensate for any gap occurring between the frame of an installed screen and the frame of the structure into which the screen is installed. The vinyl or felt tongue is held in place by means of a "T" groove running the length of the outside edge of the frame and into which is inserted the "T"-shaped base of the vinyl or felt extender tongue.

In lieu of an extender tongue inserted directly on the main screen frame, there is known in the prior art the use of an extender frame constructed of aluminum, stainless steel, or similar metal or metal alloy and which is attached to a cross-sectionally rectangular (but not L-shaped) main screen frame. Such an extender frame is generally cut to the same length as the vertical side of the main screen frame to which it is to be attached, and cross-sectionally is constructed in the shape of a "U", with square rather than curved corners (inside and outside), in order to fit lengthwise over the edge of the rectangular main screen frame. Each length of extender frame is provided with two rather than one vinyl or felt extender tongues, installed as described above, with one extender tongue extending outward in the same plane as the screen mesh as described above (the "first" tongue), and the other extender tongue extending perpendicularly to one side of the plane of the screen mesh (the "second" tongue), but running lengthwise in the same direction as the first extender tongue.

The extender frame was used to compensate for sizing of a standard form screen, such compensation occurring in the plane of the screen mesh between the main screen frame and the structure into which the screen is installed. In addition, however, the extender frame allowed the screen to seal in a second direction or plane.

There is further known in the prior art various designs of metal screen window and door frames in which a horizontal brace anchoring the bottom of an upper screen section and the top of a lower screen section (or a vertical brace anchoring left and right screen sections) is used. The ends of the horizontal brace are attached to the vertical jambs of the screen frame by any of a number of means, and the capacity of the brace to hold the upper and lower screen sections varies according to the method of attachment used.

It is the object of this invention to teach improvements to the design of screens used for windows, doors, porches, etc., including but not limited to increasing the screen frame's grip of the screen mesh when a tension retainer bar as described above is used, and facilitating the construction of a screen that uses a tension retainer bar.

It is a further object of the present invention to introduce new and unique applications and combinations of vinyl or felt extender tongues extending directly from the screen frame.

It is yet another object of the present invention to strengthen the bracing capacity of horizontal or vertical center braces of screen windows and doors and other screen frames.

DISCLOSURE OF THE INVENTION

The invention comprises a series of improvements to the design of metal screen frames. One of these improvements is the use of a groove and retainer walls molded in an L-shaped screen frame to secure the edge of a tension retainer bar against being pushed away from the frame when a force is applied against the screen mesh on the side opposite of the retainer bar, and a change in the design of the L-shaped frame to maintain the structural integrity of the frame despite the addition of the just-referenced groove. Another of these improvements is a dual line of fasteners attaching the tension retainer bar to the frame. A third of these improvements is a groove or grooves on the tension retainer bar to prevent lateral shifting of the point of each fastener as it is being installed on the retainer bar and frame. A fourth of these improvements is a vinyl or felt extender tongue installed on the frame perpendicular to the screen mesh, either alone or in conjunction with an extender tongue extending from the frame in the same plane as the screen mesh. A fifth of these improvements is the attachment of a vertical or horizontal center brace to the frame by means of hidden insertion keys and/or the insertion of the ends of the brace into slots in the outside members of the frame. Each of the improvements comprising the present invention may stand alone or be used in conjunction with any combination or all of the other improvements.

BRIEF DESCRIPTION OF THE DRAWINGS

For a further understanding of the nature and objects of the present invention, reference is made to the following drawings, taken in conjunction with the specifications in which like parts are given like reference numbers, and wherein.

PREFERRED EMBODIMENT OF THE INVENTION

Figure 1:
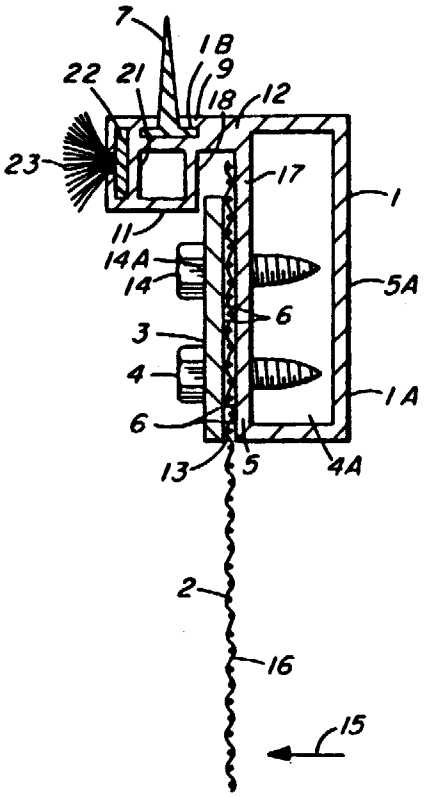
FIG. 1 is a cross-sectional view of a portion of a screen mesh and a single length of molded screen frame, illustrating certain described aspects of the preferred embodiment of the present invention.
Figure 2:
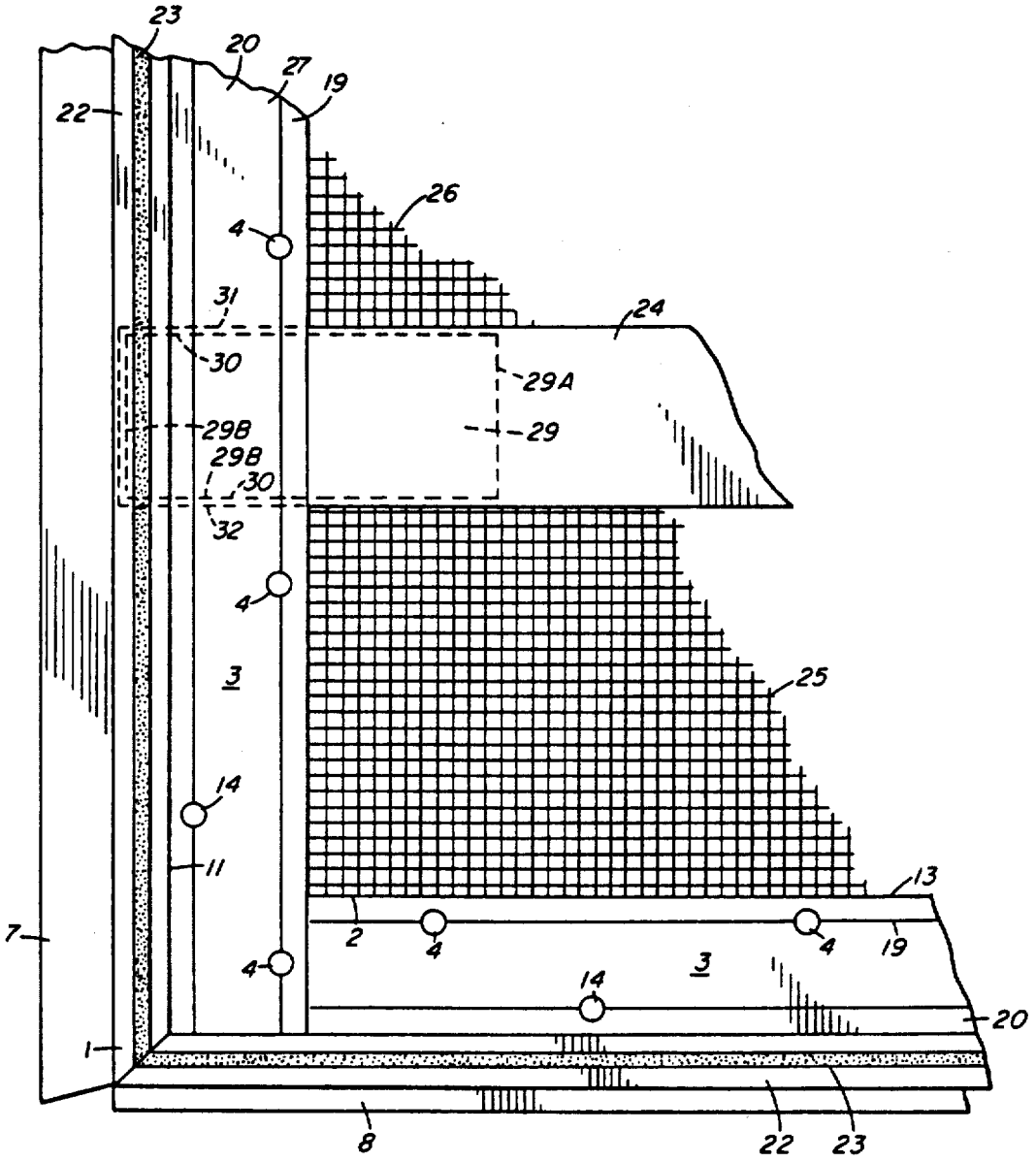
FIG. 2 is a frontal view of the bottom lefthand corner of a screen standing vertically, showing a screen mesh, a screen frame, and a horizontal brace incorporating the preferred embodiment of the present invention as described below.

FIG. 1 shows a hollow, two-channel (lengthwise) L-shaped (cross-sectionally), single piece extruded aluminum-alloy frame 1, with a tensile strength of, for example, 22,000 PSI and weight of, for example, 0.380 pounds per foot. A heavy screen mesh or cloth 2 is provided, such as a stainless steel screen mesh with, for example, a 16×16 mesh and being, for example, 0.018 inch in diameter, sufficiently strong so that screen mesh 2 is no more likely to tear than frame 1 or fasteners 4 are likely to break or otherwise release their hold on screen mesh 2. FIG. 2 illustrates a screen of the same specifications, but showing two pieces of frame 1 attached to form a corner of the screen. Screen mesh 2 is secured to frame 1 by retainer bar 3 and a line of regular-spaced fasteners 4, which are screwed or driven through retainer bar 3, screen mesh 2, and main retainer wall 5 of frame 1. When fasteners 4 are fully inserted, the tips thereof protrude into the hollow 4A of long arm 1A of frame 1 but do not reach front wall 5A. Ridges 6 on the underside of retainer bar 3 and the topside of main retainer wall 5 run lengthways to hold screen mesh 2 securely along the entire vertical and horizontal lengths of frame 1. Vinyl extender tongue 7 (or alternatively a felt tongue 8) is inserted lengthways into T-groove 9 in outside wall 12 of frame 1 and extends outward from frame 1 in the same plane as screen mesh 2.

Unlike the prior art, the present invention teaches the use of retainer groove 10 in short arm 1B of frame 1, at the corner formed cross-sectionally by main retainer wall 5 of frame 1 and inside wall 11 of frame 1, interrupting the line of inside wall 11 and extending main retainer wall 5 to outside wall 12 of frame 1. New inner retainer wall 18 runs from inside wall 11 to outside wall 12. Retainer groove 10 runs the entire length of each of the four sides of a complete frame 1. The edges of screen mesh 2 and retainer bar 3 fit more or less snugly into retainer groove 10 and are held in place by line of fasteners 4, which in the present invention is situated closer to the inside edge 13 of retainer bar 3, and by a second line of regularly-spaced fasteners 14 situated close to inside wall 11. Because of the use of two lines of fasteners 4 and 14, the space between fasteners of the same line of fasteners 4 or 14 is greater than the spacing of fasteners in the prior art.

The present invention's use of a second line of fasteners 14, in conjunction with the present invention's addition of retainer groove 10, increases the holding capacity of frame 1 against forces 15 applied against the front side 16 of screen mesh 2. In the prior art, such a force 15 may cause screen mesh 2 and retainer bar 3 to be pushed away from main retainer wall 5 and thereby decrease the holding pressure of retainer bar 3 and of main retainer wall 5 on screen mesh 2. Under the present invention, this loosening action is prevented or limited by the second line of fasteners 14 and/or the restraining action of inner retainer wall 18 of retainer groove 10 against the otherwise upwardly (from main retainer wall 5) moving retainer bar 3. Inner retainer wall 18 is especially effective if force 15 is sufficient to lift fasteners 14 to the point where the bottom of the head 14A of each fastener 14 is a greater distance from main retainer wall 5 than is inner retainer wall 18.

The present invention also adds shallow fastener grooves 19 and 20 for lines of fasteners 4 and 14, respectively. These fastener grooves 19 and 20 assist in the quick and efficient assembly of the screen by preventing the points of fasteners 4 and 14 from slipping laterally during insertion, regardless of the lengthwise placement of each fastener 4 or 14.

The present invention further introduces the placement of T-groove 21 in rear wall 22 of short arm 1B of frame 1, into which is inserted lengthwise a second vinyl or felt extender tongue 23 (shown as felt in FIGS. 1 and 2). This second extender tongue 23, uniquely situated perpendicularly lengthwise to extender tongue 7 and perpendicular to the plane of screen mesh 2, allows the screen to be adjusted in either of two directions or planes to achieve the closest fit upon installation, with either groove 7 or 23 on any side of the screen compensating for gaps otherwise occurring between frame 1 of an installed screen and the frame of the structure in or onto which the screen is installed, without the use of a separate extender frame. For example, the closest overall fit may be achievable only by installing the screen so that there is little or no gap around frame 1 in the same plane as screen mesh 2 and extender tongue 7, yet causing a significant gap in any of the four planes (one for each side of the screen) perpendicular to screen mesh 2 extending inward from rear wall 22. These gaps can be closed or narrowed by extender tongue 23. Even if no significant gap exists between rear wall 22 and the structure in which the screen is installed, a felt extender tongue 23 insures a tight fit, furthering such purposes as preventing insects from passing between the screen and structure.

The structural integrity of frame 1, which might otherwise be lessened by the inclusion of retainer groove 10, is maintained by inner retainer wall 18, by moving T-groove 9 further toward rear wall 22, and by increasing the diameter of outside wall 12 between main retainer wall 5 and inner retainer wall 18.

Figure 3:
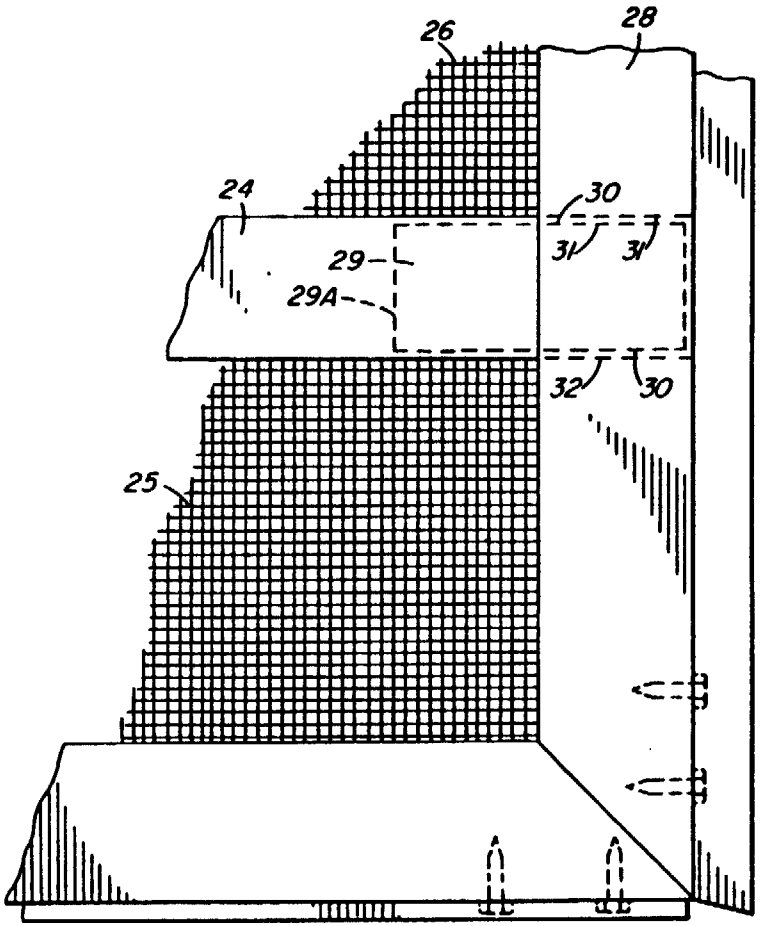
FIG. 3 is a frontal view of the bottom righthand corner of a screen door likewise illustrating certain aspects of the present invention.

Referring now to the horizontal center brace 24 shown in FIGS. 2 and 3, the present invention teaches means to more securely fix said brace 24 against stresses exerted in any direction, but especially against vertical stresses upward or downward caused by forces applies against any of the two or more screen mesh panels 25

(lower panel) or 26 (upper panel). Under the present invention, brace 24 is secured at each end (drawings show only one end) to window vertical frame member 27 or door jambs 28 by means of insertion key 29, which is inserted snugly first into slot 29A of center brace 24 and then into slot 29B of vertical frame member 27 or door jamb 28, so that insertion key 29 is hidden from view. Alternatively, or in conjunction with an insertion key 29, the end of brace 24 is itself inserted into a slot 30 built into vertical frame member 27 or door jamb 28 for this purpose. Under either construction, upward and downward vertical stresses on brace 24 are resisted by a solid top inner retainer wall 31 or solid bottom inner retainer wall 32 of either slot 29B or slot 30, rather than solely by fasteners. Similar principles would apply to a vertical center brace to increase its resistance against horizontal sideways stresses.

Because many varying and different embodiments may be made within the scope of the inventive concept taught herein, including equivalent structures of materials hereafter thought of, and because many modifications may be made in the embodiments herein detailed in accordance with the descriptive requirements of the law, it is to be understood that the details herein are to be interpreted as illustrative and not in a limiting sense.

What is claimed as invention is:

1. A screen mesh and frame combination, comprising a screen mesh;

a frame, having a hollow interior and a metal exterior, said screen mesh being wider and longer than said interior of said frame and resting on said metal exterior;

said metal exterior having a first portion coplaner with said mesh and a second portion substantially perpendicular to said first portion and connected to the outermost part of said first portion and a third portion parallel to said first portion and extending inwardly from said second portion, said three portions forming a first groove between said first and third portions with said second portion forming the vertical wall of said first groove, said screen mesh resting partially in said first groove substantially over its entire perimeter; and a retainer mechanism abutting said screen mesh on the side of said screen mesh opposite said first portion, said retainer mechanism having holding means for holding said screen against said first portion, said retainer mechanism extending into said first groove, wherein said holding means includes a first set of fasteners and a retainer plate, said retainer plate extending the length of said first portion, said fasteners extending through said retainer plate, said screen mesh and said first portion.

* * * * *